United States Patent [19]

Ulbing

[11] 3,940,173

[45] Feb. 24, 1976

[54] SAFETY HOOK

[75] Inventor: Otmar M. Ulbing, Webster, N.Y.

[73] Assignee: Columbus McKinnon Corporation, Tonawanda, N.Y.

[22] Filed: Feb. 10, 1975

[21] Appl. No.: 548,627

[52] U.S. Cl. ..... 294/82 R; 24/241 PS

[51] Int. Cl.[2] ..... B66C 1/36

[58] Field of Search ..... 294/78 R, 82 R, 83 R; 24/230.5 AC, 230.5 SA, 232, 238, 239, 241 P, 241 PP, 241 TC, 241 PS, 241 PL, 241 SL, 241 SP, 242

[56] References Cited

UNITED STATES PATENTS

| | | | |
|---|---|---|---|
| 1,334,830 | 3/1920 | Bastord | 24/241 PS |
| 1,376,258 | 4/1921 | Cox | 24/241 PS |
| 1,660,927 | 2/1928 | Larsen | 24/241 PS |
| 2,857,644 | 10/1958 | Gale | 24/232 X |
| 3,722,943 | 3/1973 | Kalua | 294/82 R |

*Primary Examiner*—James B. Marbert
*Assistant Examiner*—Johnny D. Cherry
*Attorney, Agent, or Firm*—Bean & Bean

[57] ABSTRACT

A safety hook for use with lifting hoists and the like features a thumb operated keeper latch device arranged adjacent an end of a hook body gripping groove, which serves to both protect the fingers of an operator and position and operator's thumb for engagement with the latch device.

4 Claims, 6 Drawing Figures

SAFETY HOOK

BACKGROUND OF THE INVENTION

The present invention is directed to improvements in safety hoists of the general type including a hook body; a keeper, which is pivotally mounted on the hook body for movements between hook closed and open positions; and a latch device for normally retaining the keeper in its hook closed position. Prior disclosures of various forms of this general type of safety hook include U.S. Pat. Nos. 1,956,786 and 3,722,943 and Swedish Patent No. 319,883.

SUMMARY OF THE INVENTION

The safety hook of the present invention constitutes a departure from prior designs of the type described above in the construction of the latch device employed and the arrangement of such latch device adjacent the end of a hook body gripping groove, which is arranged in relation to the latch device for guidingly positioning the thumb of an operator in operative association with the latch device.

DRAWINGS

The nature and mode of operation of the present invention is now more clearly described in the following detailed description taken with the accompanying drawings wherein.

DETAILED DESCRIPTION

Figure 1:
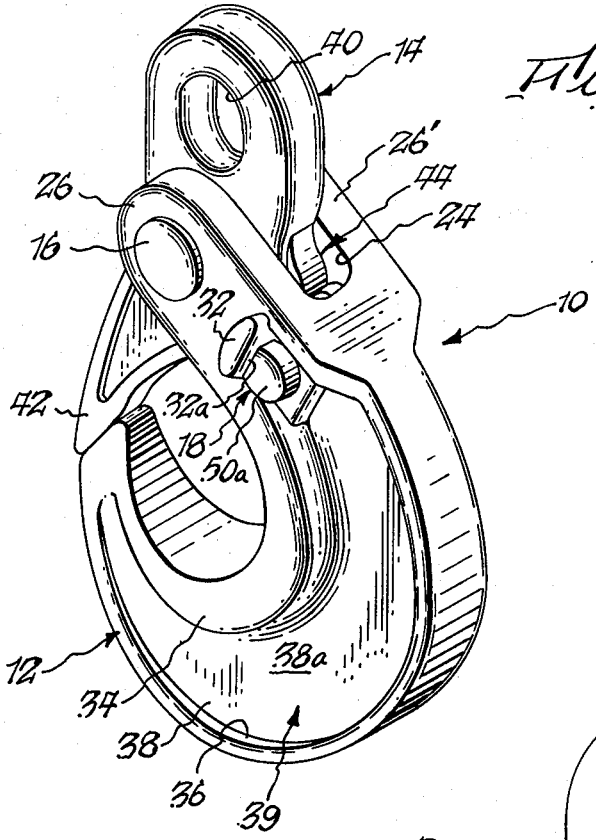
FIG. 1 is a perspective view of the safety hook incorporating the present invention.
Figure 2:
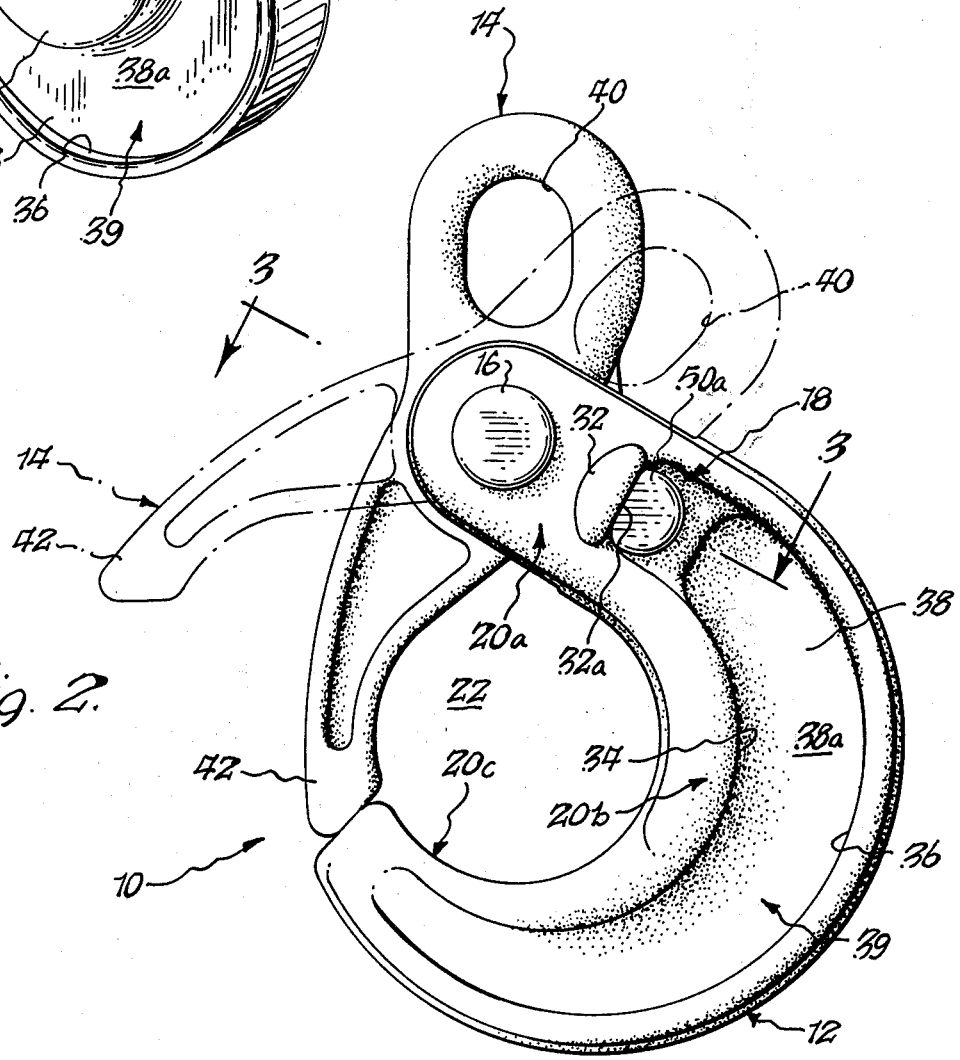
FIG. 2 is a side elevational view of the safety hook.

Reference is now made particularly to FIGS. 1 and 2, wherein the safety hook of the present invention is designated as 10. Safety hook 10 generally includes a hook body portion 12; a keeper 14, which is secured to body portion 12 by a pivot pin 16 for pivotal movements about the axis of such pivot pin between the hook closed and open positions shown in full and phantom line in FIG. 2, respectively; and a manually operable latch device 18 for releasably retaining keeper 14 in its closed position.

More specifically, body portion 12 includes a keeper and latch device mounting portion 20*a;* an intermediate hook gripping portion 20*b;* and an arcuate load bearing portion 20*c*, which cooperates with intermediate portion 20*b* and keeper 14 to define a through opening 22 for receiving a cable or other rigging device, not shown, by which a suitable load may be supported.

Portion 20*a* is formed with a slot 24, which defines a pair of ears 26, 26′ spaced apart sufficiently to receive keeper 14 therebetween. Ears 26, 26′ are provided with axially aligned mounting openings 28, 28′ to receive opposite ends of pivot pin 16. Portion 20*a* is also formed with a transversely extending through opening 30, which is preferably of circular cross-sectional configuration and extends essentially parallel to the keeper pivot axis and communicates with slot 24 intermediate its ends. One end of opening 30 is partially blocked by an enlarged stop or abutment portion 32, which projects transversely outwardly of ear 26, as best shown in FIGS. 1, 3 and 5.

Intermediate portion 20*b* is of a generally I-shaped, cross-sectional configuration and includes an inner or finger protecting flange portion 34, an outer or strengthening flange portion 36 and a connecting or gripping flange portion 38, which cooperate to define oppositely facing gripping grooves 39, 39*a*. As will be apparent from viewing FIG. 1, the width or transverse dimension of flange portion 34 is substantially in excess of the like dimension of outer flange portion 36. The configuration of intermediate portion 20*b* is such as to permit an operator's hand to comfortably enclose outer flange portion 36 with his thumb and fingers arranged within the grooves in gripping engagement with opposite, generally planar side surfaces 38*a* and 38*b* of connecting flange portion 38, respectively; inner flange portion 34 extending from side surfaces 38*a* and 38*b* sufficiently to prevent engagement of a cable or the like arranged within opening 22 with the thumb or fingers of the operator. It will also be noted that the upper end of thumb receiving groove 39 "points" toward and terminates immediately adjacent to latch device 18.

Figure 4:
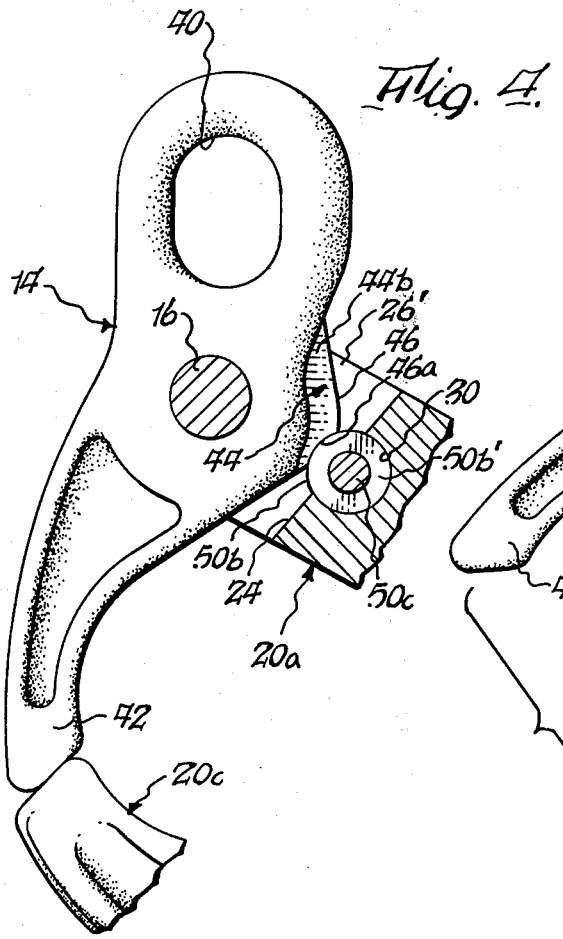
FIG. 4 is a sectional view taken generally along the line 4—4 in FIG. 3.
Figure 6:
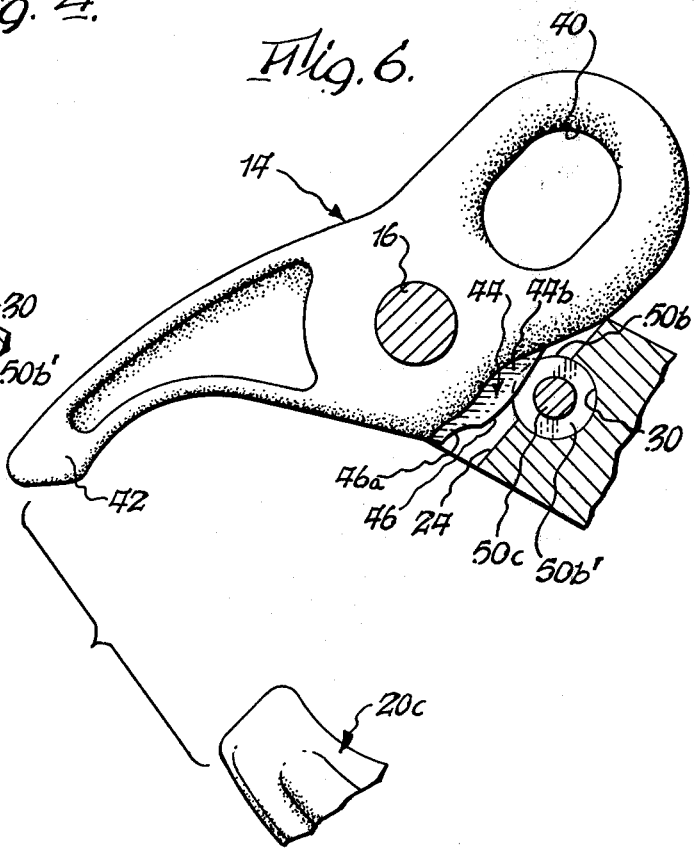
FIG. 6 is a sectional view taken generally along the line 6—6 in FIG. 5.

Keeper 14 is provided with an upper supporting end portion having an eye 40 for permitting safety hook 10 to be secured to a lifting hoist or the like, not shown, and a lower, pointed end portion 42, which is removably engageable with bearing portion 20*c* to releasably retain a cable or the like within opening 22. Keeper 14 is also formed intermediate its ends with an elongated and relatively narrow rib portion 44, which has generally parallel side surfaces 44*a* and 44*b* extending transversely of the axis of pivot pin 16 and an edge surface 46 arranged to face opening 30. Edge surface 46 is best shown in FIGS. 4 and 6 as being provided with a concave notch 46*a*. Rib portion 44 cooperates with latch device 18 to releasably retain the keeper in either its closed or open positions in the manner to be described.

Figure 3:
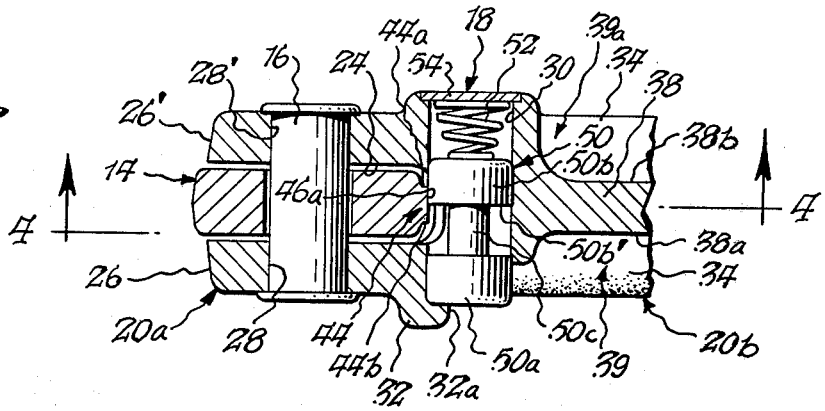
FIG. 3 is a sectional view taken generally along the line 3—3 in FIG. 2.
Figure 5:
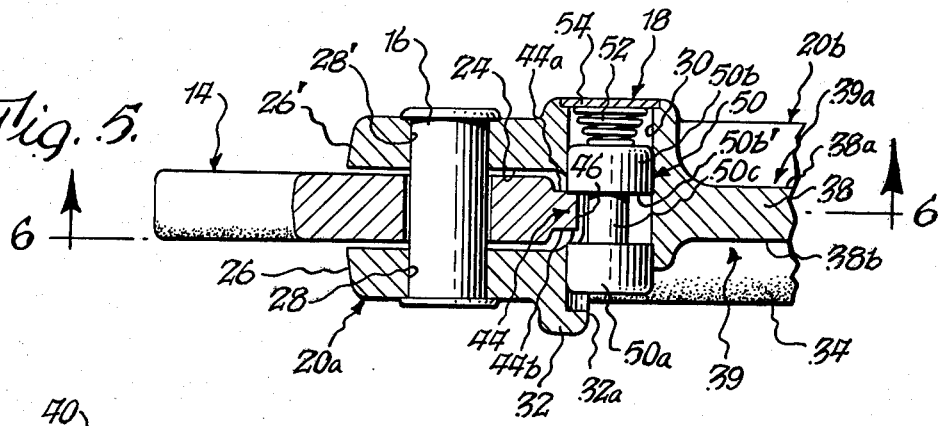
FIG. 5 is a sectional view similar to FIG. 3, but showing the keeper disposed in its open position.

Latch device 18 is best shown in FIGS. 3 and 5 as including a latch-operator member 50, which is preferably of a "bar-bell" configuration to permit it to be received within bore opening 30 for both rotation and axial reciprocating movement along a path of travel disposed essentially parallel to the pivot axis of keeper 14; a suitable spring device, such as coil spring 52; and a suitable closure device, such as a press fitted plate 54, which cooperates with stop 32 to confine member 50 and spring 52 within bore opening 30. Specifically, member 50 includes a generally cylindrical operator or push button end portion 50*a;* a generally cylindrical latch end portion 50*b;* and a generally cylindrical reduced diameter, intermediate connecting portion 50*c*, which is of a length in excess of a distance between rib side surfaces 44*a* and 44*b*. Alternatively, member 50 could be of a non-round, such as square, cross-sectional configuration, but this would of course prevent rotation of the member within opening 30, which is desirable for the reason hereinafter described.

As indicated in FIGS. 3 and 4, spring 52 tends to bias member 50 towards a latched position, wherein latch end portion 50*a* is disposed in end surface engagement with the inner surface of stop 32 and latch end portion 50*b* has its cylindrical or side surface arranged in latching engagement within rib notch 46*a*. In this condition of member 50, keeper 14 is latched in its hook closed position shown in FIGS. 1, 2, 3 and 4.

An operator may release keeper 14 for movement into its open position shown in FIGS. 5 and 6 and in phantom line in FIG. 2 by first grasping intermediate portion 20*b* in the manner described above and then applying thumb pressure to end portion 50*a*; thumb receiving groove 39 cooperating with side surface 32*a* of abutment 32 to positionally locate the end of the operator's thumb in pressure applying engagement with end portion 50*a*. Thumb pressure serves to axially displace member 50 against the bias of spring 52 into its unlatched position shown in FIG. 5, wherein latch end portion 50*b* is removed from within notch 46*a* in order to free keeper 14 for pivotal movement towards its fully open position shown in FIGS. 5 and 6, wherein rib 44 extends into opening 30 intermediate end portions 50*a* and 50*b*. Upon release of thumb pressure on end portion 50*a*, spring 52 tends to return member 50 to its latched position, but is prevented from doing so due to blocking engagement of the radially extending stop surface 50*b* of latch end portion 50*b* with rib side surface 44*a*. The latch device is thus operative to frictionally retain keeper 14 in its open position. When it is desired to return keeper 14 to its latched or closed position, it is merely necessary to manually swing the keeper in a counter-clockwise direction, as viewed in FIG. 6, sufficiently to return the keeper to the position shown in FIG. 4, whereupon rib side surface 44*a* is removed from engagement with latch end portion surface 50*b'* and spring 52 automatically serves to return member 50 to its latched position shown in FIG. 3. During swinging movement of keeper 14 towards closed position, sliding frictional engagement between surfaces 44*a* and 50*b'* causes member 50 to rotate within bore opening 30. This rotational movement of member 50 each time keeper 14 is opened and closed assists in maintaining the cylindrical surfaces of end portions 50*a* and 50*b* and the walls of bore opening 30 free from accumulations of foreign particles, which might otherwise "freeze" member 50 against unlatching movements within the bore opening.

I claim:

1. In a safety hook including a hook body portion having a mounting portion, a load bearing portion and a hook gripping portion connecting said mounting and load bearing portions, said mounting portion being formed with a slot to define a pair of spaced ears, said ears having a pair of axially aligned openings; a pivot pin extending transversely between said ears and being end supported within said aligned openings; a keeper having a pointed end portion, said keeper being mounted by said pivot pin intermediate said ears for movements about a pivot axis between hook closed and open positions, wherein said pointed end portion is disposed in and removed from engagement with said load bearing portion, respectively; and a latch device carried by said hook body portion for releasably retaining said keeper in said hook closed position, the improvement wherein:

said mounting portion is formed with an opening arranged to extend transversely thereof and essentially parallel to said pivot axis, said opening communicating with said slot at a point intermediate the ends thereof, and said mounting portion having an abutment partially blocking one end of said ends of said opening;

said latch device includes a member mounted within said opening for reciprocating movements lengthwise thereof between latched and unlatched positions, and spring means arranged within said opening for biasing said member into said latched position; and said keeper is formed with a rib arranged intermediate said ears, said rib having opposite side surfaces and an edge surface arranged to face said opening, said edge surface having a notch formed therein, said latched position of said member being defined by engagement of one end of said member with said abutment, said one end of said member being accessible to an operator of said safety hook through said one end of said opening to permit operator pressure to be applied to said one end of said member for moving said member against the bias of said spring means from said latched position into said unlatched position, said member when in said latched position being engageably received within said notch to prevent movement of said keeper from said hook closed position and when in said unlatched position being removed from within said notch to permit movements of said keeper between said hook closed and open positions.

2. The improvement according to claim 1, wherein said member has an operating end portion defining said one end of said member, a latch end portion and an intermediate portion connecting said operating and latch end portions, said intermediate portion having a transverse dimension measured transversely of said member less than said latch end portion whereby to provide said latch end portion with a transversely extending stop surface and a lengthwise dimension measured lengthwise of said member in excess of the distance between said side surfaces of said rib, said latch end portion being disposed in and removed from latching engagement with said notch when said member is disposed in said latched and unlatched positions respectively, said intermediate portion being arranged in alignment with said slot when said member is in said unlatched position whereby to permit movement of said rib into said opening intermediate said operating and latch end portions incident to movements of said keeper between said hook closed and open positions, and said stop surface being maintained by said spring means in engagement with one of said side surfaces of said rib when disposed in said opening for frictionally retaining said keeper in said hook open position.

3. The improvement according to claim 2, wherein said opening is of circular cross-sectional configuration and said member is of a bar-bell shaped configuration with said operating and latch end portions and said intermediate portion being of cylindrical configuration, said member being driven for rotary movements within said opening by frictional surface engagement between said one side surface of said rib and said stop surface as said keeper is pivoted from said hook open position into said hook closed position.

4. The improvement according to claim 1, wherein said hook gripping portion has a generally I-shaped cross-sectional configuration thereby to define a pair of oppositely facing grooves for separately accommodating the thumb and fingers of an operator, and the one of said grooves serving to accommodate the thumb of the operator terminating adjacent said one end of said opening and cooperating with said abutment to positionally locate an end of the thumb of the operator in pressure applying engagement with said one end of said member.

* * * * *